US005235669A

United States Patent [19]

Ordentlich et al.

[11] Patent Number: 5,235,669

[45] Date of Patent: Aug. 10, 1993

[54] LOW-DELAY CODE-EXCITED LINEAR-PREDICTIVE CODING OF WIDEBAND SPEECH AT 32 KBITS/SEC

[75] Inventors: Erik Ordentlich, Palo Alto, Calif.; Yair Shoham, Berkeley Heights, N.J.

[73] Assignee: AT&T Laboratories, Murray Hill, N.J.

[21] Appl. No.: 546,627

[22] Filed: Jun. 29, 1990

[51] Int. Cl.[5] ..... G10L 9/00

[52] U.S. Cl. ..... 395/2

[58] Field of Search ..... 381/29-50; 364/513.5, 724.19

[56] References Cited

U.S. PATENT DOCUMENTS

| | | | |
|---|---|---|---|
| Re. 32,580 | 1/1988 | Atal et al. | 381/40 |
| 4,133,976 | 1/1979 | Atal et al. | 381/47 |
| 4,472,832 | 9/1984 | Atal et al. | 381/40 |
| 4,694,298 | 9/1987 | Milan | 364/724.19 |
| 4,701,954 | 10/1987 | Atal | 381/49 |
| 4,811,261 | 3/1989 | Kobayashi et al. | 364/724.19 |
| 4,827,517 | 5/1989 | Atal et al. | 381/41 |
| 4,941,178 | 7/1990 | Chuang | 381/41 |

FOREIGN PATENT DOCUMENTS

| | | |
|---|---|---|
| 0331405 | 2/1989 | European Pat. Off. . |
| 2624675 | 6/1989 | France . |

OTHER PUBLICATIONS

"Stochastic Coding of Speech Signals at Very Low Bit Rates", *Proc. IEEE Int. Conf. Comm.*, May 1984, B. S. Atal and M. R. Schroeder, pp. 1610-1612.

"Code-Excited Linear Prediction (CELP): High-Quality Speech at Very Low Bit Rates", *Proc. IEEE Int. Conf. ASSP.*, 1985, pp. 937-940, M. R. Schroeder and B. S. Atal.

"A Class of Analysis-by-Synthesis Predictive Coders for High Quality Speech Coding at Rates Between 4.8 and 16 kbits/s", *IEEE J. on Sel. Area in Comm.*, SA-C-6(2) Feb. 1988, pp. 353-363, P. Kroon and E. F. Deprettere.

"Predictive Coding of Speech Signals and Subjective Error Criteria", *IEEE Tr. ASSP*, vol. ASSP-27, No. 3, Jun. 1979, pp. 247-254, B. S. Atal and M. S. Schroeder.

"Low Delay Code Excited Linear Predictive (LD--CELP) Coding of Wide Band Speech at 32Kbit/sec.," MS Thesis, EE Dept., MIT, Jul. 1990, E. Ordentlich, Abstract only (p. 1).

"Transfor Coding of Audio Signals Using Perceptual Noise Criteria", *IEEE Sel. Areas in Comm.*, vol. 6, No. 2, Feb. 1988, pp. 314-323, J. D. Johnston.

"G.722, A New CCITT Coding Standard for Digital Transmission of Wideband Audio Signals", *IEEE Comm. Mag.*, vol. 26, No. 1, Jan. 1988, pp. 8-15, P. Mermelstein.

"Strategies for improving the performance of CELP coders at low bit rates", ICASSP'88 (1988 International Conf. on Acoustics, Speech, and Signal Processing), vol. 1, pp. 151-154, IEEE, New York; P. Kroon, et al.

"Some experiments of 7 kHz audio coding at 16 kbit/s", ICASSP '89 (1989 International Conference on Acoustics, Speech, and Signal Processing), May 1989, vol. 1, pp. 192-195, IEEE, New York; R. Drogo de Jacovo, et al.

"On different vector predictive coding schemes and their application to low bit rates speech coding", Signal Processing IV: Theories and Applications (Proceedings of EUSIPCO-88, 4th European Signal Processing Conf.) Sep. 1988, vol. II, pp. 871-874, North Holland Publishing Co.; F. Bottau, et al.

*Primary Examiner*—David D. Knepper

*Attorney, Agent, or Firm*—William Ryan

[57] ABSTRACT

An improved digital communication system, e.g., a CELP code/decoder based system, is improved for use with a wide-band signal such as a high-quality speech signal by modifying the noise weighting filter used in such systems to include a filter section which affects primarily the spectral tilt of the weighting filter in addition to a filter component reflecting formant frequency information in the input signal. Alternatively, the weighting is modified to reflect perceptual transform techniques.

20 Claims, 2 Drawing Sheets

LOW-DELAY CODE-EXCITED LINEAR-PREDICTIVE CODING OF WIDEBAND SPEECH AT 32 KBITS/SEC

FIELD OF THE INVENTION

The present invention relates to methods and apparatus for efficiently coding and decoding signals, including speech signals. More particularly, this invention relates to methods and apparatus for coding and decoding high quality speech signals. Yet more particularly, this invention relates to digital communication systems, including those offering ISDN services, employing such coders and decoders.

BACKGROUND OF THE INVENTION

Recent years have witnessed many improvements in coding and decoding for digital communications systems. U.S. Pat. No. 4,133,976, issued on Jan. 9, 1979; RE 32,580, issued on Jan. 19, 1988; 4,701,954, issued on Oct. 27, 1987; 4,472,832, issued on Sep. 18, 1984, and 4,827,517, issued on May 2, 1989, to B. S. Atal, et al and assigned to the assignee of the present invention, all present important improvements in this field.

One area of such improvements have came to be called code excited linear predictive (CELP) coders and are, e.g., described B. S. Atal and M. R. Schroeder, "Stochastic Coding of Speech Signals at Very Low Bit Rates," *Proc. IEEE Int. Conf. Comm.*, May 1984, p. 48.1; M. R. Schroeder and B. S. Atal, "Code-Excited Linear Predictive (CELP): High Quality Speech at Very Low Bit Rates," *Proc. IEEE Int. Conf. ASSP.*, 1985, pp. 937–940; P. Kroon and E. F. Deprettere, "A Class of Analysis-by-Synthesis Predictive Coders for High-Quality Speech Coding at Rate Between 4.8 and 16 Kb/s," *IEEE J. on Sel. Area in Comm* SAC-6(2), Feb. 1988, pp. 353–363, and the above-cited U.S. Pat. No. 4,827,517. Such techniques have found application, e.g., in voice grade telephone channels, including mobile telephone channels.

The prospect of high-quality multi-channel/multi-user speech communication via the emerging ISDN has increased interest in advanced coding algorithms for wideband speech. In contrast to the standard telephony band of 200 to 3400 Hz, wideband speech is assigned the band 50 to 7000 Hz and is sampled at a rate of 16000 Hz for subsequent digital processing. The added low frequencies increase the voice naturalness and enhance the sense of closeness whereas the added high frequencies make the speech sound crisper and more intelligible. The overall quality of wideband speech as defined above is sufficient for sustained commentary-grade voice communication as required, for example, in multi-user audio-video teleconferencing. Wideband speech is, however, harder to code since the data is highly unstructured at high frequencies and the spectral dynamic range is very high. In some network applications, there is also a requirement for a short coding delay which limits the size of the processing frame and reduces the efficiency of the coding algorithm. This adds another dimension to the difficulty of this coding problem.

SUMMARY OF THE INVENTION

Many of the advantages of the well-known CELP coders and decoders are not fully realized when applied to the communication of wide-band speech information (e.g., in the frequency range 50 to 7000 Hz). The present invention, in typical embodiments, seeks to adapt existing CELP techniques to extend to communication of such wide-band speech and other such signals.

More particularly, the illustrative embodiments of the present invention provide for modified weighting of input signals to enhance the relative magnitude of signal energy to noise energy as a function of frequency. Additionally, the overall spectral tilt of the weighting filter response characteristic is advantageously decoupled from the determination of the response at particular frequencies corresponding, e.g., to formants.

Thus, whereas prior art CELP coders employ a weighting filter based primarily on the formant content, it proves advantageous in accordance with a teaching of the present invention to use a cascade of prior art weighting filter and an additional filter section for controlling the spectral tilt of the composite weighting filter.

DETAILED DESCRIPTION

To simplify the description of the present invention, the above-cited publications by Atal and Schroeder, and the cited U.S. Pat. No. 4,133,976 to Atal and Schroeder are hereby incorporated by reference and should be deemed included in the present disclosure as if set forth in their entirety.

Figure 1:
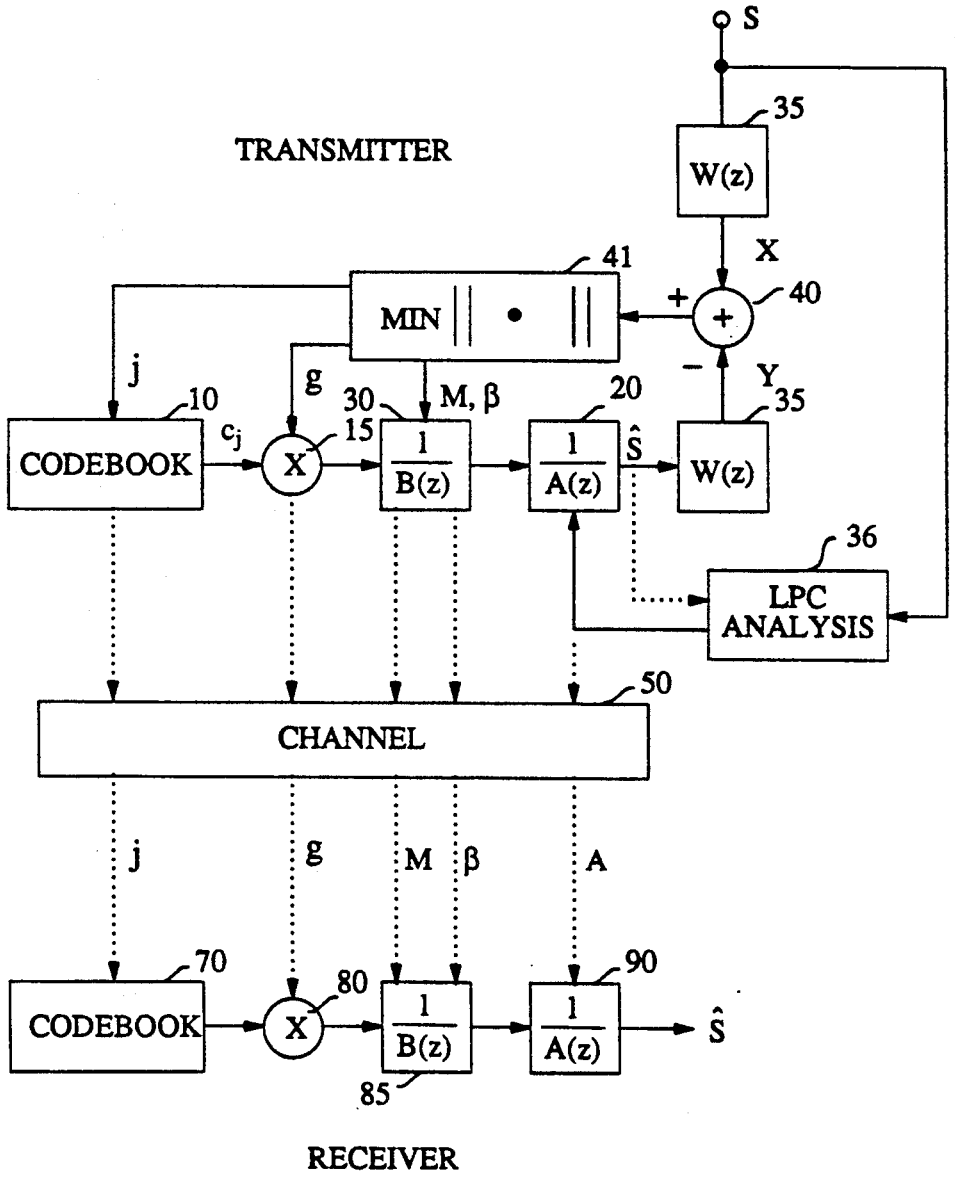
FIG. 1 shows a digital communication system using the present invention.

The basic structure of conventional CELP (as described, e.g., in the references cited above) is shown in FIG. 1.

Shown are the transmitter portion at the top of the figure, the receiver portion at the bottom and the various parameters (j, g, M, $\beta$ and A) that are transmitted via a communication channel 50. CELP is based upon the traditional excitation-filter model where an excitation signal, drawn from an excitation codebook 10, is used as an input to an all-pole filter which is usually a cascade of an LPC-derived filter 1/A(z) (20 in FIG. 1) and a so-called pitch filter 1/B(z), 30. The LPC polynomial is given by $$A(z) = \sum_{i=0}^{M} a_i z^{-i}$$

and is obtained by a standard $M^{th}$-order LPC analysis of the speech signal. The pitch filter is determined by the polynomial $$B(z) = \sum_{j=0}^{q} b_j z^{-j-p}$$

where P is the current "pitch" lag—a value that best represents the current periodicity of the input and $b_j$'s are the current pitch taps. Most often, the order of the pitch filter is q=1 and it is rarely more than 3. Both polynomial A(z), B(z) are monic.

The CELP algorithm implements a closed-loop (analysis-by-synthesis) search procedure for finding the best excitation and, possibly, the best pitch parameters. In the excitation search loop, each of the excitation vectors is passed through the LPC and pitch filters in an effort to find the best match (as determined by comparator 40 and minimizing circuit 41) to the output, usually, in a weighted mean-squared error (WMSE) sense. As seen in FIG. 1, the WMSE matching is accomplished via the use of a noise-weighting filter W(z) 35. The input speech s(n) is first pre-filtered by W(z) and the resulting signal x(n) ($X(z)=S(z)\ W(z)$) serves as a reference signal in the closed-loop search. The quantized version of x(n), denoted by y(n), is a filtered excitation, closest to x(n) in an MSE sense. The filter used in the search loop is the weighted synthesis filter $H(z)=W(z)/[B(z)\ A(z)]$. Observe, however, that the final quantized signal is obtained at the output of the unweighted synthesis filter $1/[B(z)\ A(z)]$, which means that W(z) is not used by the receiver to synthesize the output. This loop essentially (but not strictly) minimizes the WMSE between the input and output, namely, the MSE of the signal $(S(z)-\hat{S}(z))\ W(z)$.

The filter W(z) is important for achieving a high perceptual quality in CELP systems and it plays a central role in the CELP-based wideband coder presented here, as will become evident.

The closed-loop search for the best pitch parameters is usually done by passing segments of past excitation through the weighted filter and optimizing B(z) for minimum WMSE with respect to the target signal X(z). The search algorithm will be described in more detail.

As shown in FIG. 1, the codebook entries are scaled by a gain factor g applied to scaling circuit 15. This gain may either be explicitly optimized and transmitted (forward mode) or may be obtained from previously quantized data (backward mode). A combination of the backward and forward modes is also sometimes used (see, e.g., AT&T Proposal for the CCITT 16 Kb/s speech coding standard, COM N No. 2, STUDY GROUP N, "Description of 16 Kb/s Low-Delay Code-excited Linear Predictive Coding (LD-CELP) Algorithm," March 1989). See also U.S. patent application Ser. No. 07/298451, entitled "A Low-Delay Code-Excited Linear Predictive Coder for Speech or Audio," by J-H. Chen, filed Jan. 17, 1989, and assigned to the assignee of the present invention, which application is hereby incorporated in this disclosure by reference as if set forth in its entirety.

In general, the CELP transmitter codes and transmits the following five entities: the excitation vector (j), the excitation gain (g), the pitch lag (p), the pitch tap(s) ($\beta$), and the LPC parameters (A). The overall transmission bit rate is determined by the sum of all the bits required for coding these entities. The transmitted information is used at the receiver in well-known fashion to recover the original input information.

The CELP is a look-ahead coder, it needs to have in its memory a block of "future" samples in order to process the current sample which obviously creates a coding delay. The size of this block depends on the coder's specific structure. In general, different parts of the coding algorithm may need different-size future blocks. The smallest block of immediate future samples is usually required by the codebook search algorithm and is equal to the codevector dimension. The pitch loop may need a longer block size, depending on the update rate of the pitch parameters. In a conventional CELP, the longest block length is determined by the LPC analyzer which usually needs about 20 msec worth of future data. The resulting long coding delay of the conventional CELP is therefore unacceptable in some applications. This has motivated the development of the Low-Delay CELP (LD-CELP) algorithm (see above-cited AT&T Proposal for the CCITT 16 Kb/s speech coding standard).

The Low-Delay CELP derives its name from the fact that it uses the minimum possible block length-the vector dimension. In other words, the pitch and LPC analyzers are not allowed to use any data beyond that limit. So, the basic coding delay unit corresponds to the vector size which only a few samples (between 5 to 10 samples). The LPC analyzer typically needs a much longer data block than the vector dimension. Therefore, in LD-CELP the LPC analysis can be performed on a long enough block of most recent past data plus (possibly) the available new data. Notice, however, that a coded version of the past data is available at both the receiver and the transmitter. This suggests an extremely efficient coding mode called backward-adaptive-coding. In this mode, the receiver duplicates the LPC analysis of the transmitter using the same quantized past data and generates the LPC parameters locally. No LPC information is transmitted and the saved bits are assigned to the excitation. This, in turn, helps in further reducing the coding delay since having more bits for the excitation allows using shorter input blocks. This coding mode is, however, sensitive to the level of the quantization noise. A high-level noise adversely affects the quality of the LPC analysis and reduces the coding efficiency. Therefore, the method is not applicable to low-rate coders. It has been successfully applied in 16 Kb/s LD-CELP systems (see above-cited AT&T Proposal for the CCITT 16 Kb/s speech coding standard) but not as successfully at lower rates.

When backward LPC analysis becomes inefficient due to excessive noise, a forward-mode LPC analysis can be employed within the structure of LD-CELP. In this mode, LPC analysis is performed on a clean past signal and LPC information is sent to the receiver. Forward-mode and combined forward-backward mode LD-CELP systems are currently under study.

The pitch analysis can also be performed in a backward mode using only past quantized data. This analysis, however, was found to be extremely sensitive to channel errors which appear at the receiver only and cause a mismatch between the transmitter and receiver. So, in LD-CELP, the pitch filter B(z) is either completely avoided or is implemented in a combined backward-forward mode where some information about the pitch delay and/or pitch tap is sent to the receiver.

The LD-CELP proposed here for coding wideband speech at 32 Kb/s advantageously employs backward LPC. Two versions of the coder will be described in greater detail below. The first includes forward-mode pitch loop and the second does not use pitch loop at all. The general structure of the coder is that of FIG. 1, excluding the transmission of the LPC information. Also, if the pitch loop is not used, $B(z)=1$ and the pitch information is not transmitted. The algorithmic details of the coder are given below.

A fundamental result in MSE waveform coding is that the quantization noise has a flat spectrum at the point of minimization, namely, the difference signal between the output and the target is white. On the other hand, the input speech signal is non-white and actually has a wide spectral dynamic range due to the formant structure and the high-frequency roll-off. As a result, the signal-to-noise ratio is not uniform across the frequency range. The SNR is high at the spectral peaks and is low at the spectral valleys. Unless the flat noise is reshaped, the low-energy spectral information is masked by the noise and an audible distortion results. This problem has been recognized and addressed in the context of CELP coding of telephony-bandwidth speech (see "Predictive Coding of Speech Signals and Subjective Error Criteria," IEEE Tr. ASSP, Vol. ASSP-27, No. 3, June 1979pp. 247–254). The solution was in a form of a noise weighting filter, added to the CELP search loop as shown in FIG. 1. The standard form of this filter is:

$$W(z) = \frac{A(z/g_1)}{A(z/g_2)}\ ;\ 0 \leqq g_2 < g_1 \leqq 1; \tag{1}$$

where A(z) is the LPC polynomial. The effect of $g_1$ or $g_2$ is to move the roots of A(z) towards the origin, de-emphasizing the spectral peaks of 1/A(z). With $g_1$ and $g_2$, as in Eq. (1), the response of W(z) has valleys (anti-formants) at the formant locations and the inter-formant areas are emphasized. In addition, the amount of an overall spectral roll-off is reduced, compared to the speech spectral envelope as given by 1/A(z).

In the CELP system of FIG. 1, the unweighted error signal $E(z)=Y(z)-X(z)$ is white since this is the signal that is actually minimized. The final error signal is $$\hat{S}(z)-S(z)=E(z)W^{-1}(z) \tag{2}$$

and has the spectral shape of $W^{-1}(z)$. This means that the noise is now concentrated in the formant peaks and is attenuated in between the formants. The idea behind this noise shaping is to exploit the auditory masking effect. Noise is less audible if it shares the same spectral band with a high-level tone-like signal. Capitalizing on this effect, the filter W(z) greatly enhances the perceptual quality of the CELP coder.

In contrast to the standard telephony band of 200 to 3400 Hz, the wideband speech considered here is characterized by a spectral band of 50 to 7000 Hz. The added low frequencies enhance the naturalness and authenticity of the speech sounds. The added high frequencies make the sound crisper and more intelligible. The signal is sampled at 16 KHz for digital processing by the CELP system. The higher sampling rate and the added low frequencies both make the signal more predictable and the overall prediction gain is typically higher than that of standard telephony speech. The spectral dynamic range is considerably higher than that of telephony speech where the added high-frequency region of 3400 to 6000 Hz is usually near the bottom of this range. Based on the analysis in the previous section, it is clear that, while coding of the low-frequency region should be easier, coding of the high-frequency region poses a severe problem. The initial unweighted spectral SNR tends to be highly negative in this region. On the other hand, the auditory system is quite sensitive in this region and the quantization distortions are clearly audible in a form of crackling and hiss. Noise weighting is, therefore, more crucial, in wideband CELP. The balance of low to high frequency coding is more delicate. The major effort in this study was towards finding a good weighting filter that would allow a better control of this balance.

Figure 2:
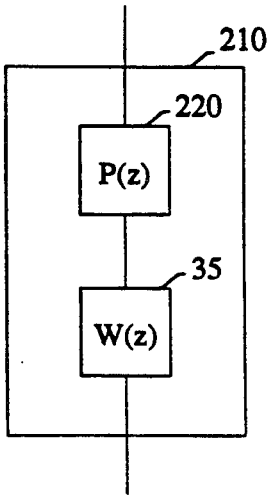
FIG. 2 shows a modification of the system of FIG. 1 in accordance with the embodiment of the present invention.

A starting point for the better understanding of the technical advance contributed by the present invention is the weighting filter of the conventional CELP as in Eq. (1). The initial goal was to find a set ($g_1$, $g_2$) for best perceptual performance. It was found that, similar to the narrow-band case, the values $g_1=0.9$, $g_2=0.4$ produced reasonable results. However, the performance left room for improvement. It was found that the filter W(z) as in Eq. (1) has an inherent limitation in modeling the formant structure and the required spectral tilt concurrently. The spectral tilt has been found to be controlled approximately by the difference $g_1$-$g_2$. The tilt is global in nature and it is not readily possible to emphasize it separately at high frequencies. Also, changing the tilt affects the shape of the formants of W(z). A pronounced tilt is obtained along with higher and wider formants, which puts too much noise at low frequencies and in between the formants. The conclusion was that the formant and tilt problems ought to be decoupled. The approach taken was to use W(z) only for formant modeling and to add another section for controlling the tilt only. The general form of the new filter is $$Wp(z)=W(z)P(z) \tag{3}$$

where P(z) is responsible for the tilt only. The implementation of this improvement is shown in FIG. 2 where the weighting filter 35 of FIG. 1 is replaced by a cascade of filter 220 having a response given by P(z) with the original filter 35. The cascaded filter Wp(z) is given by Eq. (3). Various forms of P(z) were studied. They will be mentioned here very briefly. A detailed discussion of these forms can be found in E. Ordentlich, "Low Delay Code Excited Linear Predictive (LD-CELP) Coding of Wide Band Speech at 32 Kbit/sec.," MS Thesis, EE Dept., MIT, July 1990. The appendix to this application includes pre-published portions of this thesis. This appendix is enclosed on an interim basis; when the exact date of publication of the thesis is known, the appendix will be selectively deleted.

The forms studied were: fixed three-pole (two complex, one real) section, fixed three-zero section, adaptive three-pole section, adaptive three-zero section and adaptive two-pole section. The fixed sections were designed to have an unequal but fixed spectral tilt, with a steeper tilt at high frequencies. The coefficients of the adaptive sections were dynamically computed via LPC analysis to make $P^{-1}(z)$ a 2nd or 3rd-order approximation of the current spectrum, which essentially captures only the spectral tilt.

In addition, one mode chosen for P(z) was a frequency-domain step function at mid range. This attenuates the response at the lower half of the range and boosts it at the higher half by a predetermined constant. A 14th-order all-pole section was used for this purpose.

It was found by careful listening tests that the two-pole section was the best choice. For this case, the section is given by $$P(z) = \frac{1}{1 + \sum_{i=1}^{2} p_i \delta^i z^{-i}} \tag{4}$$

The coefficients $p_i$ are found by applying the standard LPC algorithm to the first three correlation coefficients of the current-frame LPC inverse filter (A(z)) sequence $a_i$. The parameter $\delta$ is used to adjust the spectral tilt of P(z). The value $\delta=0.7$ was found to be a good choice. This form of P(z), in combination with W(z), where g1=0.98, g2=0.8, yielded the best perceptual performance over all other systems studied in this work.

In addition to the P(z) method described above, the first non-P(z) method is based on psycho-acoustical perception theory (see Brian C. J. Moore, "An Introduction to the Psychology of Hearing," Academic Press Inc., 1982) currently applied in Perceptual Transform Coding (PTC) of audio signals (see also James D. Johnson, "Transform Coding of Audio Signals Using Perceptual Noise Criteria," IEEE Sel. Areas in Comm., 6(2), February 1988, and K. Brandenburg, "A Contribution to the Methods and the Evaluation of Quality for High-Grade Musi Coding," PhD Thesis, Univ. of Erlangen-Nurnberg, 1989). In PTC, known psycho-acoustical auditory masking effects are used in calculating a Noise Threshold Function (NTF) of the frequency. According to the theory, any noise below this threshold should be inaudible. The NTF is used in determining the bit allocation and/or the quantizer step size for each of the transform coefficient which, later, are used to re-synthesize the signal with the desired quantization noise shape. The idea studied in the work was to use the NTF in the framework of LPC-based coder like CELP. Basically, W(z) was designed to have the NTF shape for the current frame. The NTF, however, may be a fairly complex function of the frequency, with sharp dips and peaks. Therefore, a high-order pole-zero filter is advantageously used in accurate modeling of the NTF as is well-known in the art. Related teachings for selecting a filter having the NTF characteristic will be found in U.S. patent application Ser. No. 423,088 by K. Brandenburg, et al, filed Oct. 18, 1989, and assigned to the assignee of the present invention.

A second approach that has been successfully used is split-band CELP coding in which the signal is first split into low and high frequency bands by a set of two quadrature-mirror filters (QMF) and then, each band is coded separately by its own coder. A similar method was used in P. Mermelstein, "G.722, a New CCITT Coding Standard for Digital Transmission of Wideband Audio Signals," IEEE Comm. Mag., pp. 8–15, January 1988. This approach provides the flexibility of assigning different bit rates to the low and high bands and to attain an optimum balance of high and low spectral distortions. Flexibility is also achieved in the sense that entirely different coding systems can be employed in each band, optimizing the performance for each frequency range. In the present illustrative embodiment, however, LD-CELP is used in all (two) bands. Various bit rate assignments were tried for the two bands under the constraint of a total rate of 32 Kb/s. The best ratio of low to high band bit assignment was found to be 3:1.

All of the systems mentioned above can include various pitch loops, i.e., various orders for B(z) and various number of bits for the pitch taps. One interesting point is that it sometimes proves advantageous to use a system without a pitch loop, i.e., B(z)=1. In fact, in some tests, such a system offered the best result. The explanation for this may be the following. The pitch loop is based on using past residual sequences as an initial excitation of the synthesis filter. This constitutes a 1st-stage quantization in a two-stage VQ system where the past residual serves as an adaptive codebook. Two-stage VQ is known to be inferior to single-stage (regular) VQ at least from an MSE point of view. In other words, the bits are better spent if used with a single excitation codebook. Now, the pitch loop offers maily perceptual improvement due to the enhanced periodicity, which is important in low rate coders like 4–8 Kb/s CELP, where the MSE SNR is low anyway. At 32 Kb/s, with high MSE SNR, the pitch loop contribution does not outweigh the efficiency of a single VQ configuration and, therefore, there is no reason for its use.

Figure 3:
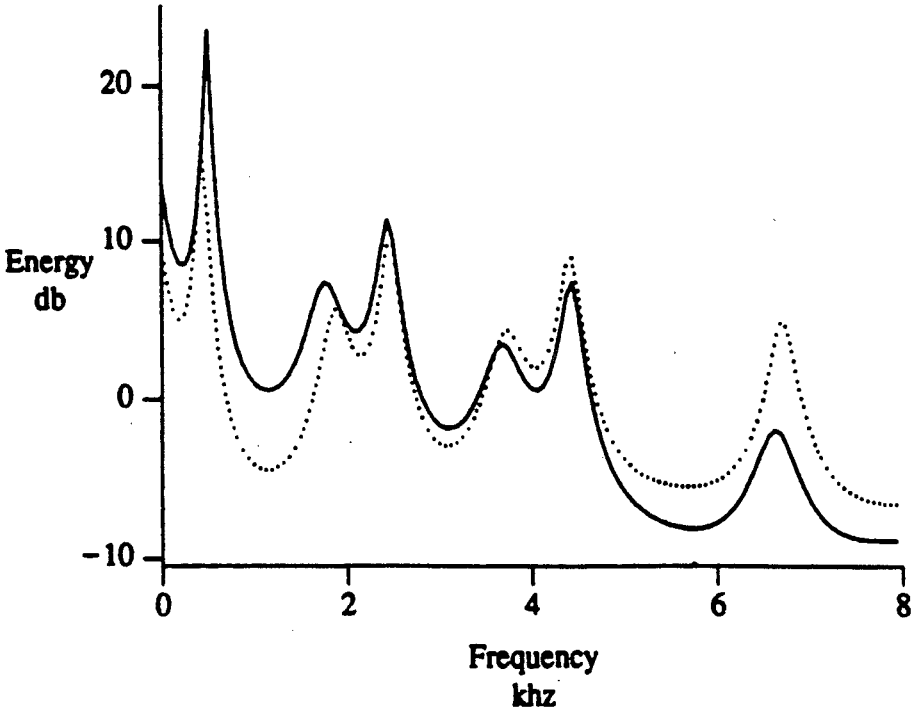
FIG. 3 shows a modified frequency response resulting from the application of a typical embodiment of the present invention.

While the above description has proceeded in terms of wide-band speech, it will be clear to those skilled in the art that the present invention will have application in other particular contexts. FIG. 3 shows a representative modification of the frequency response of the overall weighting filter in accordance with the teachings of the present invention. In FIG. 3 a solid line represents weighting in accordance with a prior art technique and the dotted curve corresponds to an illustrative modified response in accordance with a typical exemplary embodiment of the present invention.

We claim:

1. A method for coding a speech signal comprising
   generating a plurality of parameter signals representative of said speech signal,
   synthesizing a plurality of estimate signals based on said parameter signals, each of said estimate signals being identified by a corresponding index signal,
   performing a frequency weighted comparison of each of said estimate signals with said speech signal, said weighting relatively emphasizing
      perceptually significant frequencies within a band-limited frequency spectrum of said speech signal, and
      higher frequencies to a greater degree than lower frequencies within said band-limited spectrum, and
   representing said speech signal by at least one of said corresponding index signals identifying said estimate signals which, upon said comparison, meet a preselected comparison criterion.

2. The method of claim 1 wherein said comparison criterion comprises a minimization of the difference between said weighted speech signal and each of said weighted estimate signals.

3. The method of claim 1 wherein said perceptually significant frequencies are associated with formants of said speech signal.

4. The method of claim 1 further comprising representing said speech signal by at least one of said parameter signals.

5. The method of claim 1 wherein said synthesizing of said estimate signals comprises applying each of an ordered plurality of code vectors to a synthesizing filter to generate a corresponding one of said estimate signals.

6. The method of claim 5 wherein said parameter signals comprise signals representative of short term characteristics of said speech signal.

7. The method of claim 1 wherein said emphasizing said higher frequencies to a greater degree than said lower frequencies comprises imposing a tilt to said band-limited spectrum of said speech signal and each of said estimate signals.

8. The method of claim 7 wherein said frequency weighted comparison comprises filtering said speech signal and each of said estimate signals using a filter which imposes said tilt to said band-limited spectrum of said speech signal and each of said estimate signals, and comparing the result of said filtering of said speech signal with the result of said filtering of each of said estimate signals.

9. The method of claim 8 wherein said filter comprises quadrature mirror filter sections having a plurality of frequency bands, and said generating a plurality of parameter signals, said synthesizing a plurality of estimate signals, said performing a frequency weighted comparison, and said representing said speech signal by said index signals, are performed separately for each frequency band.

10. The method of claim 8 wherein said filter comprises a first frequency weighting section for relatively emphasizing said perceptually significant frequencies, and a second frequency weighting section for imposing said tilt to said band-limited spectrum of said speech signal and each of said estimate signals.

11. The method of claim 10 wherein said second frequency weighting section is characterized by a transfer function, P(z), where $$P(z) = \frac{1}{1 + \sum_{i=1}^{2} p_i \delta^i z^{-i}},$$

wherein said coefficients $p_1$ are based on said parameter signals representative of said speech signal, and $\delta$ is a predetermined constant.

12. The method of claim 10 wherein said second frequency weighting section comprises a three-pole filter section.

13. The method of claim 10 wherein said second frequency weighting section comprises a three-zero filter section.

14. The method of claim 10 wherein said second frequency weighting section comprises a two-pole filter section.

15. The method of claim 10 wherein said second frequency weighting section comprises a two-zero filter section.

16. The method of claim 10 wherein said transfer function of said second frequency weighting section is characterized by a first function for the range of frequencies below a predetermined frequency substantially in the center of said band-limited spectrum of said input signal, and a second function for the range of frequencies above said predetermined point.

17. The method of claim 16 wherein said second frequency weighting section comprises a filter section of order greater than 3.

18. The method of claim 17 wherein said second frequency weighting section comprises a filter section of order 14.

19. The method of claim 10 wherein said speech signal comprises a time ordered sequence of frames of speech signals, said generation of said parameter signals representative of said speech signal comprises generating a plurality of parameter signals for each of said frames of speech signals, and said second frequency weighting section comprises an adaptive filter section characterized by a plurality of filter parameter signals, said filter parameter signals being based, for each of said frames of speech signals, on said parameter signals representative of said speech signal for a corresponding frame of said speech signals.

20. The method of claim 19 wherein said parameter signals representing each of said frames of speech signals includes a noise threshold function signal, and wherein said second frequency weighting section comprises a perceptual transform coding filter characterized by said noise threshold function.

* * * * *